US010157557B1

(12) United States Patent
Martin

(10) Patent No.: US 10,157,557 B1
(45) Date of Patent: Dec. 18, 2018

(54) USER CUSTOMIZABLE BLANKET

(71) Applicant: Arona Martin, Chicago, IL (US)

(72) Inventor: Arona Martin, Chicago, IL (US)

( * ) Notice: Subject to any disclaimer, the term of this patent is extended or adjusted under 35 U.S.C. 154(b) by 0 days.

(21) Appl. No.: 15/681,323

(22) Filed: Aug. 18, 2017

(51) Int. Cl.

| | |
|---|---|
| ***A47G 9/02*** | (2006.01) |
| ***A47G 9/00*** | (2006.01) |
| ***G09F 23/00*** | (2006.01) |
| ***G09F 3/02*** | (2006.01) |
| ***G09F 19/00*** | (2006.01) |
| ***G09F 3/12*** | (2006.01) |
| ***G09F 3/16*** | (2006.01) |
| ***G09F 3/08*** | (2006.01) |

(52) U.S. Cl.
CPC ..... *G09F 23/00* (2013.01); *A47G 9/0207* (2013.01); *G09F 3/02* (2013.01); *G09F 3/08* (2013.01); *G09F 3/12* (2013.01); *G09F 3/16* (2013.01); *G09F 19/00* (2013.01); *A47G 9/0223* (2013.01); *G09F 2003/027* (2013.01)

(58) Field of Classification Search
CPC ..... A47G 9/02; A47G 9/0207; A47G 9/0223; A47G 9/0238; A47G 9/0253; A47G 9/04; A47G 9/06; A47G 9/062; A47G 9/10; A47C 7/38; A47C 7/383; A63H 33/006
USPC ... 5/485, 490, 495, 496, 482, 655, 652, 639, 5/636, 417, 420; 446/227
See application file for complete search history.

(56) References Cited

U.S. PATENT DOCUMENTS 4,309,784 A * 1/1982 Cohen ..... A47G 9/0253 206/457
4,949,415 A * 8/1990 Selga ..... A47G 9/0207 40/124.01
5,167,565 A * 12/1992 Metcalf ..... A63F 9/06 446/227
D371,266 S * 7/1996 Ward ..... 5/655
5,546,620 A * 8/1996 Matthews ..... A47D 13/08 5/639
5,548,858 A * 8/1996 Shoa ..... A47G 9/02 40/675
5,551,687 A * 9/1996 Krull ..... A63B 43/007 446/85
5,898,962 A * 5/1999 McNeal ..... A47G 9/1045 40/661
5,950,888 A * 9/1999 Nolan-Brown ..... A42B 1/004 2/209.13
6,038,720 A * 3/2000 Matthews ..... A47C 7/383 5/636
6,202,235 B1 * 3/2001 Salhanick ..... A47C 3/16 40/320
6,224,450 B1 * 5/2001 Norton ..... A45F 5/02 446/26
6,427,265 B1 * 8/2002 Dix ..... A47D 15/00 5/482

(Continued)

*Primary Examiner* — Robert G Santos
(74) *Attorney, Agent, or Firm* — Michael Carton

(57) ABSTRACT

A user customizable blanket is formed by a sheet of fabric with a perimeter about the blanket in any one of a round, square, rectangular, circular, or other polygonal shape. Along the perimeter of the blanket, a plurality of spaced-apart receptacles are formed that may selectively engage and disengage a plurality of message-bearing icons. The plurality of receptacles are configured to engage and disengage the plurality of message-bearing icons without the use of an additional tool. The plurality of receptacles include any one of a hole, a snap, a hook and loop attachment, and a pin.

20 Claims, 4 Drawing Sheets

(56) References Cited

U.S. PATENT DOCUMENTS

| | | | | | |
|---|---|---|---|---|---|
| D479,938 | S * | 9/2003 | Quirk | D6/603 | |
| 6,684,422 | B2 * | 2/2004 | LeFevre | A47G 9/0223 | 2/69 |
| RE38,782 | E * | 8/2005 | Dix | A47D 15/00 | 5/482 |
| 7,090,500 | B1 * | 8/2006 | Guttman | G09B 19/24 | 434/247 |
| 7,107,638 | B2 * | 9/2006 | Wilson | A47G 9/0207 | 5/482 |
| D530,059 | S * | 10/2006 | Tenenbaum | D2/719 | |
| 7,730,564 | B2 * | 6/2010 | Moore | A47G 9/1045 | 446/72 |
| 8,137,150 | B2 * | 3/2012 | Oestreicher | A63H 33/006 | 446/227 |
| D715,519 | S * | 10/2014 | Dodd | D2/860 | |
| D773,750 | S * | 12/2016 | Tucker Wilhelm | D30/118 | |
| 2002/0095725 | A1 * | 7/2002 | Dix | A47D 15/00 | 5/482 |
| 2003/0159193 | A1 * | 8/2003 | LeFevre | A47G 9/0223 | 2/69.5 |
| 2005/0120482 | A1 * | 6/2005 | Robie | A47C 16/04 | 5/639 |
| 2005/0170742 | A1 * | 8/2005 | Oestreicher | A63H 33/006 | 446/227 |
| 2006/0130235 | A1 * | 6/2006 | Wilson | A47G 9/0207 | 5/502 |
| 2006/0183397 | A1 * | 8/2006 | Kanahele | A63H 33/006 | 446/26 |
| 2009/0253342 | A1 * | 10/2009 | Oren | A47D 5/006 | 446/227 |
| 2010/0024130 | A1 * | 2/2010 | Moore | A47G 9/0253 | 5/636 |
| 2010/0125298 | A1 * | 5/2010 | Whitney | A47G 9/0223 | 606/234 |

* cited by examiner

USER CUSTOMIZABLE BLANKET

FIELD OF THE INVENTION

This invention relates to the field of blankets. More particularly, this invention relates to the field of customization of blankets though self-expression.

BACKGROUND

Personalization of common, everyday items has gained popularity in recent times. From online blogging to crafting supply stores, there has been a surge in interest of self-expression with these items. This interest has been responded to by many manufacturers offering many different styles of similar products. For example, blankets are typically sold in a multitude of different shapes and colors.

One-way self-expression has emerged is with hand-knit blankets. Crafters have the ability of selecting different yarns or materials and can create a blanket that is as unique as they are. These types of blankets can be quite time consuming in their creation and also take a considerable amount of skill. As a result, custom blanket making is a fairly niche market enjoyed by people with ample free time, specialized tooling, and a certain level of skill.

When custom blankets are created, they represent the creator's mindset at the time of the creation. Much like a blank canvas imprinted with paints, the personalized blanket is a snapshot in time. While a snapshot in time preserves something in the past, it does not lend itself the ability to adapt and change for different occasions.

Adaptability is somewhat unique in the crafting industry. Typically, custom blankets need to have patches sewn on, or other materials knit into the textile to add to or modify the creation. This presents yet another hurdle one must traverse to further preserve the ability to self-express. More specialized tools, free time, and artistic abilities are required to modify the blanket at a later date.

What is therefore needed is way to enable people to create custom, personalized blankets in a short amount of time. What is also needed is the ability to create the personalized blanket without any special tools. This ability should also be simple to accomplish for people of varying levels of skill and artistic ability. Finally, what is needed is the ability to personalize the blanket and continue to effortlessly modify the personalization at a later date without any specialized tooling. In sum, what is needed is an improved blanket that is adapted for on-going personalization in a number of ways without tooling or specialized skills.

SUMMARY AND OBJECT OF THE INVENTION

A user customizable blanket is formed by a sheet of fabric with a perimeter about the blanket in any one of a round, square, rectangular, circular, or other polygonal shape. Along the perimeter of the blanket, a plurality of spaced-apart receptacles are formed that may selectively engage and disengage a plurality of message-bearing icons. The plurality of receptacles are configured to engage and disengage the plurality of message-bearing icons without the use of an additional tool. The plurality of receptacles include any one of a hole, a snap, a hook and loop attachment, and a pin.

The message-bearing icons include a plurality of uniquely shaped icons constructed out of one of a textile material, a paper material, a plastic material, and a mineral. The message-bearing icons may include a fastener configured for attachment with the receptacles without the use of a tool.

The fasteners may be in the form of a button, a snap, a pin, a tie, a hook and loop attachment, and a clasp.

Each message bearing icon may include a personalized, hand written message by the user. The message may also be in the form of an image such as a drawing or a photograph attached to the receptacle by the message-bearing icon. Lastly, the message may be in the form of a charm, sculpture, or other figure.

At least one pouch may also be attached to the blanket that may receive and store a plurality of objects including additional message-bearing icons capable of engagement with any one of the plurality of receptacles.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
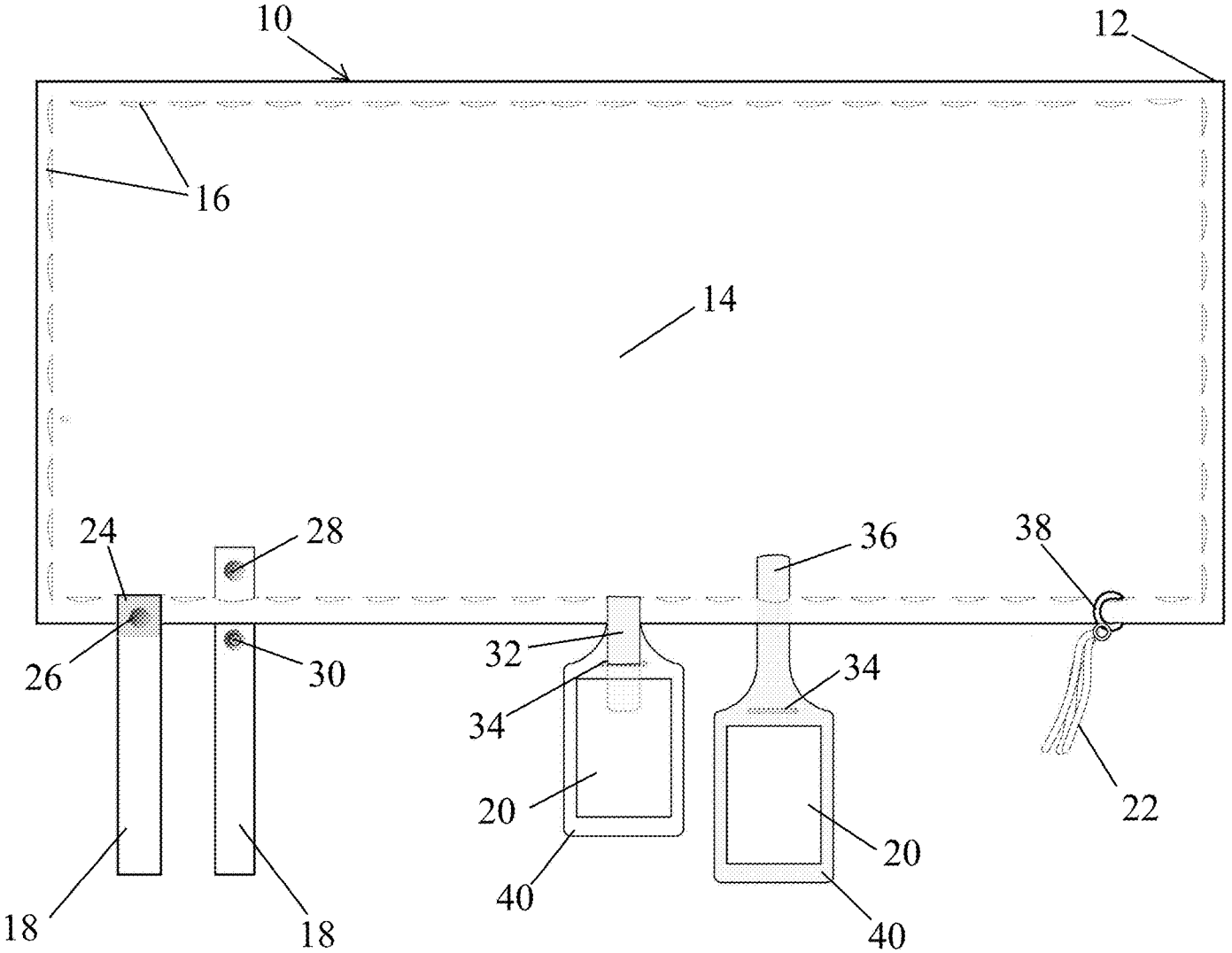
FIG. 1 shows a top view of a user-customizable blanket with a plurality of attachments.

FIG. 1 shows the blanket 10 according to one embodiment of the invention. As shown; the blanket 10 includes a body 14 defined by a perimeter 12. White a rectangular perimeter 12 is shown, the blanket 10 is not limited to a rectangular shape. The blanket 10 may be formed in a round, oval, square, or any other polygonal shape. Preferably, the perimeter 12 of the blanket 10 defines the shape of the blanket 10.

A plurality of receptacles 16 are formed in the body 14 of the blanket 10, within the perimeter 12. The receptacles 16 are preferably in the form of a through-hole passing through the body 14 of the blanket 10. Alternatively, the receptacles 16 may be in the form of a fastener that attaches to a mating fastener. The receptacles 16 may also be in the form of a loop extending from the blanket 10 to which an item may be attached. The item may be any known object, but preferably is a message-bearing icon. Overall, the purpose of the receptacles 16 is to receive a message-bearing icon in the form of a charm, a strip 18, a tag 40, and a tassel 22.

Figure 2:
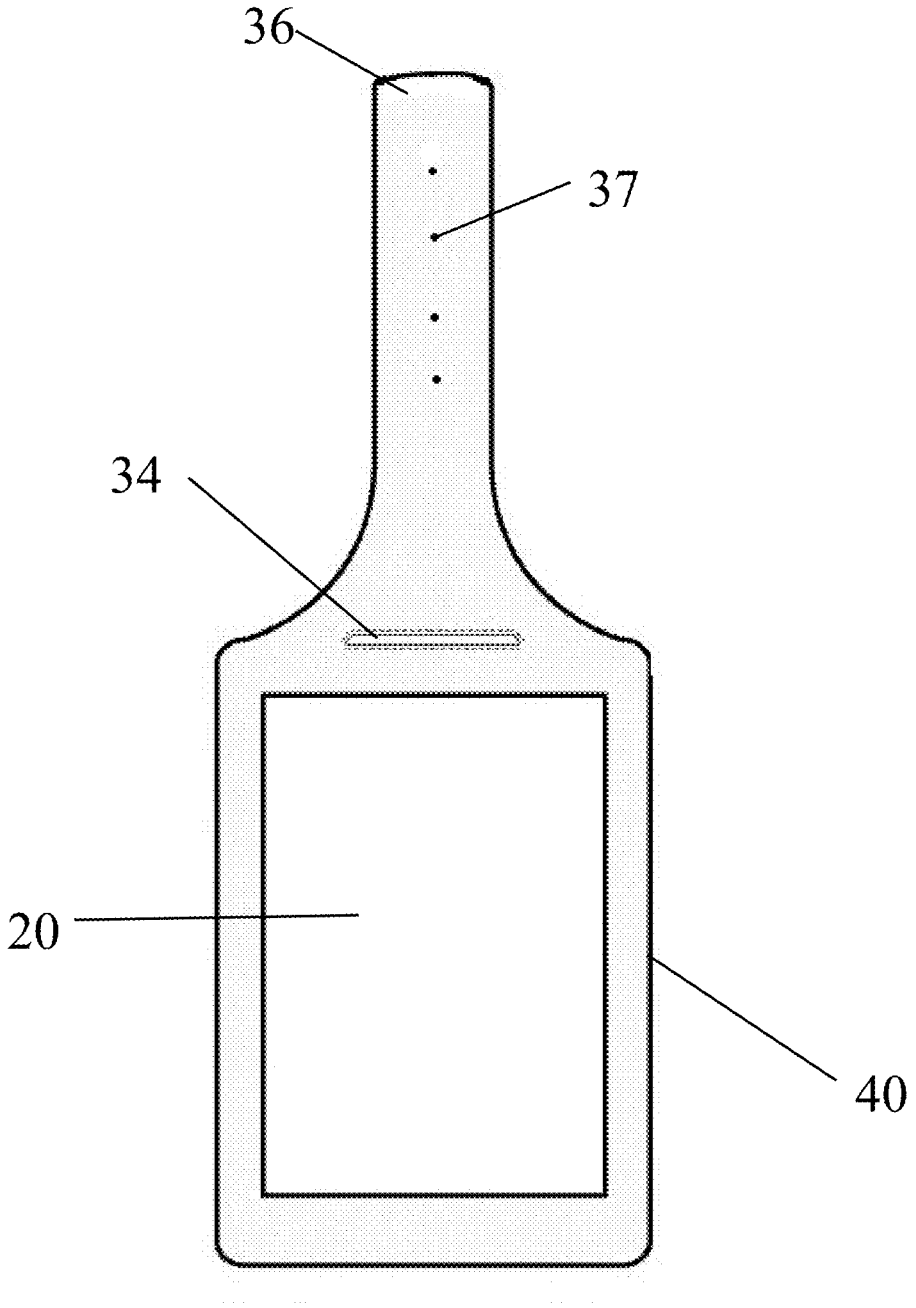
FIG. 2 shows a top view of an embodiment of a customizable attachment for the blanket of FIG. 1.

One example of a message-bearing icon is the tag 40, shown in greater detail in FIG. 2. The tag 40 may be constructed in a multitude of shapes including, but not limited to, rectangular, square, round, oval, or any other polygonal shape. The tag 40 includes a tail piece 36 that is passed through a receptacle 16 and then through a slot 34 in the body of the tag 40. A loop 32 is thereby formed around the perimeter of the blanket 10 affixing the tag 40 to the blanket 10. A plurality of holes 37 may be formed in the tail piece 36 and used with a buckle, pin, or other fastening device to keep the tail piece 36 secured in the slot 34 when a loop 32 is formed as shown in FIG. 1.

The tag 40 may include a customizable area 20. The customizable area 20 may be used to receive a hand-written message or to store a picture. The picture may be a drawing, photograph or symbol. The customizable area 20 may also include a pouch to store objects. The customizable area 20 may also include an erasable surface such as chalkboard material. The customizable area 20 is meant to provide a blank canvas for a user to express oneself in either a permanent or temporary manner.

Figure 3:
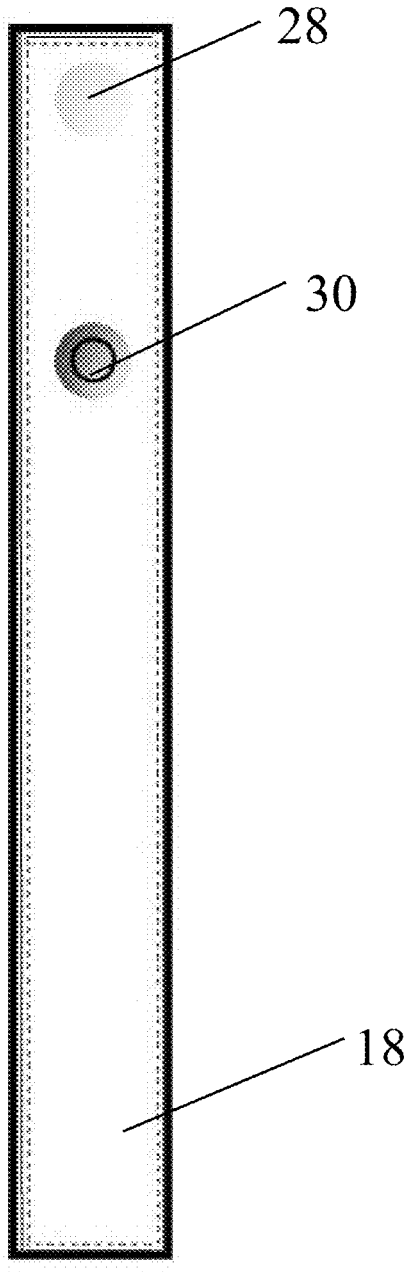
FIG. 3 shows a top view of an additional embodiment of a customizable attachment for the blanket of FIG. 1.
Figure 4:
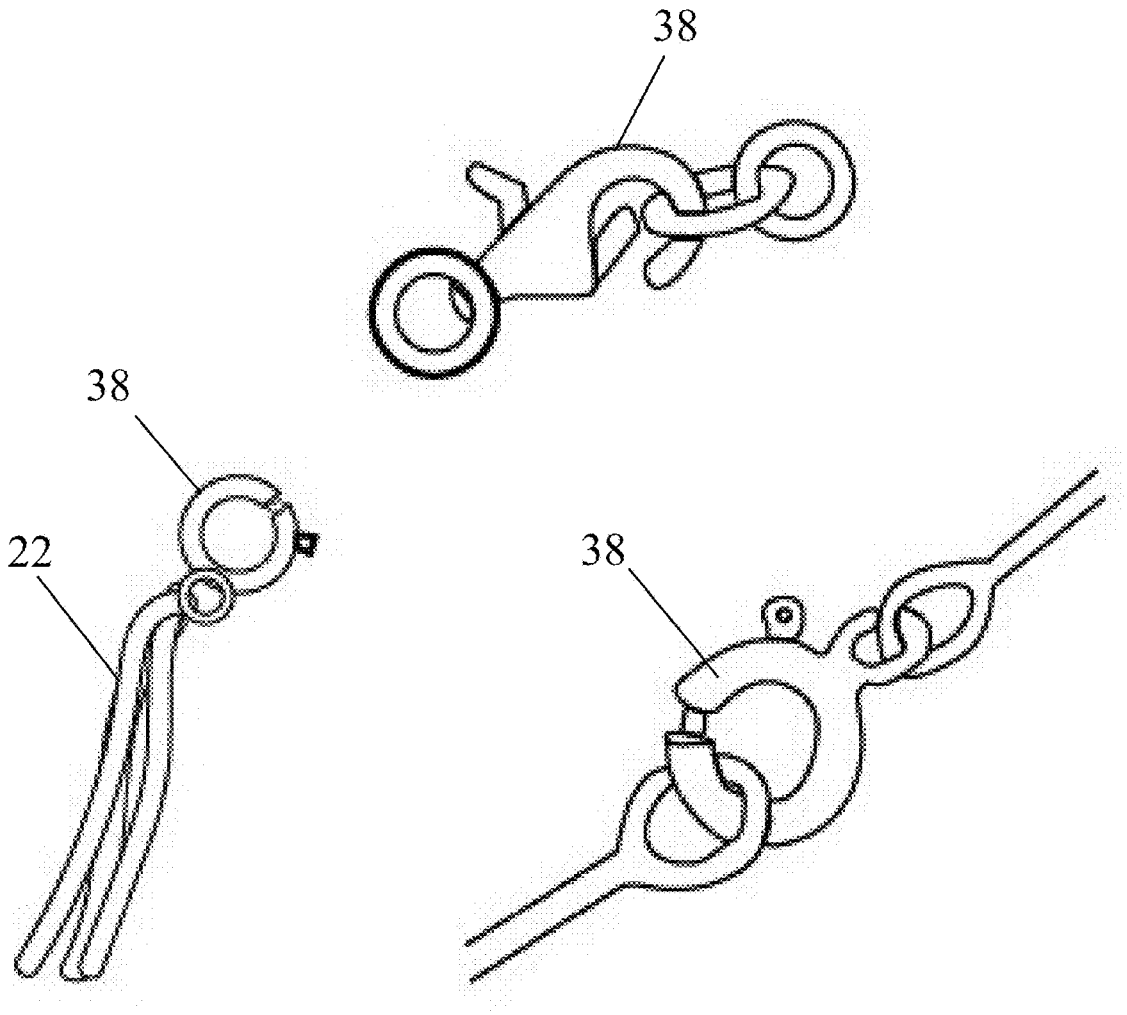
FIG. 4 shows a top view of another embodiment of a customizable attachment for the blanket of FIG. 1.

Another message-bearing icon may be in the form of a strip 18, as shown in greater detail in FIG. 3. When a strip 18 is used, it may be attached to the blanket 10 with any known fastening device. Preferably, the strip 18 is passed through a receptacle 16 forming a loop 24, as shown in FIG. 1 for example. A female snap 28 may then be joined to a male snap 30 thereby attaching the strip 18 to the blanket 10. The strip may also include a message written on it. The message may be hand-written, embroidered, printed, or any other known way. Additional objects may be affixed to the strip 18 with pins, glue, hook and loop fasteners, or any other known fastening device.

Yet another embodiment of the message-bearing icon is a tassel 22. The tassel 22 may simply be tied to a receptacle 16 or attached with any known fastening device. Preferably, a clasp 38 is used to attach the tassel 22 to the blanket 10. The tassel 22 may include multiple strands or a single strand. Each strand may be of varying length or they may be uniform. Additional objects may be attached to the tassel 22 with any known fastening device For example, beads may be tied to the tassel 22 or charms affixed to the tassel 22. The clasp 38 may be a clasp 38 as is used with jewelry or it may be any other known device used to removably attach an object.

Additional message-bearing icons may include charms, jewelry, or any other object that is used as a means of self-expression. The message on the message-bearing icon may be in the form of written words, a picture, a drawing, or a symbol. The message is intended to simply convey self-expression. For example, the blanket 10 may be given as a gift in celebration of the birth of a daughter. In such a situation it may be desirable to include a message-bearing icon in the form of a baby rattle charm or a baby bottle charm. Such a charm may be affixed to a strip 18 or a tassel 22.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

I claim:

1. A blanket comprising:

a perimeter;

a plurality of spaced-apart receptacles formed within and proximate the perimeter of the blanket configured to selectively engage and disengage a plurality of message-bearing icons;

wherein the receptacles are configured to engage and disengage the plurality of message-bearing icons without the use of an additional tool; and wherein the message-bearing icons include a plurality of uniquely shaped icons constructed out of one of a textile material, a paper material, a plastic material, and a mineral.

2. The blanket according to claim 1, further comprising at least one pouch attached to the blanket configured to receive and store a plurality of objects including additional message-bearing icons capable of engagement with any one of the plurality of receptacles.

3. The blanket according to claim 1, wherein the plurality of receptacles include any one of a hole, a snap, a hook and loop attachment, and a pin.

4. The blanket according to claim 3, wherein the message-bearing icons include a fastener configured for attachment with the receptacles without the use of a tool.

5. The blanket according to claim 4, wherein the fastener includes a button, a snap, a pin, a tie, a hook and loop attachment, and a clasp.

6. The blanket according to claim 1, wherein the perimeter forms one of a circular, oval, rectangular, and square shape.

7. The blanket according to claim 1, wherein the message-bearing icons removably attach and detach to any one of the plurality of receptacles without the use of an additional fastener.

8. A blanket comprising:

at least one edge forming a perimeter;

a plurality of spaced-apart receptacles formed within and proximate the perimeter of the blanket configured to selectively engage and disengage a plurality of message-bearing icons;

wherein the receptacles are configured to engage and disengage the plurality of message-bearing icons without the use of an additional tool; and wherein the message-bearing icons include a plurality of uniquely shaped icons constructed out of one of a textile material, a paper material, a plastic material, and a mineral.

9. The blanket according to claim 8, wherein the plurality of receptacles include any one of a hole and a snap.

10. The blanket according to claim 8, wherein the message-bearing icons include a fastener configured for removable engagement with the receptacles without the use of a tool.

11. The blanket according to claim 10, wherein the fastener includes a button, a snap, a pin, a tie, a hook and loop attachment, and a clasp.

12. The blanket according to claim 8, wherein the perimeter forms one of a rectangular and square shape.

13. The blanket according to claim 8, wherein the message-bearing icons include a message receiving surface configured to accept a user defined message and wherein the message receiving surface is adapted to receive and retain the user defined message.

14. A method of personalizing a blanket comprising:

providing a fabric sheet that is one of woven and non-woven;

forming at least one edge along the fabric sheet thereby creating a perimeter about the fabric sheet;

forming a plurality of receptacles formed within and proximate the perimeter of the fabric sheet;

selectively engaging at least one message-bearing icon with at least one of the plurality of receptacles without the use of a tool;

selectively disengaging the at least one message-bearing icon with at least one of the plurality of receptacles without the use of a tool; and modifying the at least one message-bearing icon with a message.

15. The method of personalizing a blanket according to claim 14, further comprising the step of forming the plurality of receptacles about the perimeter of the fabric sheet by opening a slot within four inches of the perimeter and spacing each receptacle between 6 inches to 12 inches from one another about the perimeter.

16. The method of personalizing a blanket according to claim 14, further comprising the step of attaching a charm to the at least one message-bearing icon and passing the charm through one of the plurality of receptacles thereby retaining the at least one message-bearing icon to the receptacle with the charm.

17. The method of personalizing a blanket according to claim 14, wherein the at least one message-bearing icon is personalized with a user-definable message by writing on the at least one message-bearing icon.

18. The method of personalizing a blanket according to claim 14, wherein the fabric sheet is formed of a woven yarn.

19. The method of personalizing a blanket according to claim 14, further comprising the step of attaching at least one pouch to the blanket configured to receive and store a plurality of objects including additional message-bearing icons capable of engagement with any one of the plurality of receptacles.

20. The method of personalizing a blanket according to claim 14, wherein the at least one message-bearing icon includes a message in one of a verbal message and a pictorial message.

* * * * *